US011782390B2

(12) United States Patent
Bonadei

(10) Patent No.: US 11,782,390 B2
(45) Date of Patent: Oct. 10, 2023

(54) WATCH CASE EQUIPPED WITH AN EXTERIOR ELEMENT

(71) Applicant: The Swatch Group Research and Development Ltd, Marin (CH)

(72) Inventor: Silvano Bonadei, Delémont (CH)

(73) Assignee: The Swatch Group Research and Development Ltd, Marin (CH)

( * ) Notice: Subject to any disclaimer, the term of this patent is extended or adjusted under 35 U.S.C. 154(b) by 50 days.

(21) Appl. No.: 17/374,192

(22) Filed: Jul. 13, 2021

(65) Prior Publication Data

US 2022/0057753 A1 Feb. 24, 2022

(30) Foreign Application Priority Data

Aug. 18, 2020 (EP) ..... 20191469

(51) Int. Cl.
*G04B 37/00* (2006.01)
*G04B 37/14* (2006.01)
*G04B 47/04* (2006.01)

(52) U.S. Cl.
CPC ..... *G04B 37/0008* (2013.01); *G04B 37/1486* (2013.01); *G04B 47/046* (2013.01)

(58) Field of Classification Search
CPC ..... G04B 37/0008; G04B 37/1486; G04B 47/046; G04B 37/22; G04B 37/1493; G04B 37/16; A44C 5/10; A44C 5/147; A44C 5/2052
See application file for complete search history.

(56) References Cited

U.S. PATENT DOCUMENTS

| | | | | |
|---|---|---|---|---|
| 2,101,690 | A | 12/1937 | Sauer, Jr. | |
| 6,779,917 | B1 | 8/2004 | Chappuis | |
| 8,790,004 | B2 * | 7/2014 | Chatelain | G04B 37/0008 368/282 |
| 10,709,213 | B2 * | 7/2020 | Zeng | A44C 5/14 |
| 10,993,512 | B2 * | 5/2021 | Rochat | G04B 37/1493 |
| 11,517,082 | B2 * | 12/2022 | Schlichtig | A44C 5/147 |
| 2014/0022875 | A1 | 1/2014 | Scioscia | |

FOREIGN PATENT DOCUMENTS

| | | |
|---|---|---|
| CN | 1137877 A | 12/1996 |
| CN | 1318159 A | 10/2001 |
| CN | 203502745 U | 3/2014 |

(Continued)

OTHER PUBLICATIONS

Office Action dated Aug. 9, 2022: in corresponding Japanese Patent Application No. 2021-115455 (with English Translation), 10 pages.

(Continued)

*Primary Examiner* — Edwin A. Leon
(74) *Attorney, Agent, or Firm* — Oblon, McClelland, Maier & Neustadt, L.L.P.

(57) ABSTRACT

A timepiece includes a watch case formed by a middle closed by a back and a crystal, the middle being equipped with horns defining a space for receiving a bracelet strand, the timepiece including a sole arranged to rest against the back, the sole, the bracelet strand and the space between the horns having shaped elements arranged to cooperate by interlocking when the middle, the sole and the strand are assembled.

10 Claims, 5 Drawing Sheets

(56) References Cited

FOREIGN PATENT DOCUMENTS

| | | | |
|---|---|---|---|
| CN | 104252125 | A | 12/2014 |
| CN | 106488717 | A | 3/2017 |
| CN | 206671775 | U | 11/2017 |
| CN | 107581725 | A | 1/2018 |
| CN | 109557796 | A | 4/2019 |
| EP | 0 359 181 | A2 | 3/1990 |
| EP | 0 359 181 | A3 | 3/1990 |
| EP | 1 070 997 | A1 | 1/2001 |
| JP | 2-128992 | U | 10/1990 |
| JP | 2003-505706 | | 2/2003 |
| JP | 2019-51345 | A | 4/2019 |
| WO | WO 2016/004292 | A1 | 1/2016 |

OTHER PUBLICATIONS

Combined Chinese Office Action and Search Report dated Oct. 26, 2022 in Chinese Patent Application No. 202110949425.7 (with Translation of Category of Cited Documents), 9 pages European Search Report dated Jan. 15, 2021 in European Application 201914694, filed on August 18, 2020 (with English Translation of Categories of cited documents) 3 pages.

* cited by examiner

WATCH CASE EQUIPPED WITH AN EXTERIOR ELEMENT

CROSS-REFERENCE TO RELATED APPLICATIONS

This application is claims the benefit of priority from prior European Application No. 20191469.4 filed Aug. 18, 2020, the entire contents of which is incorporated herein by reference.

FIELD OF THE INVENTION

The invention relates to a timepiece comprising a watch case and an exterior element that enables quick customisation.

BACKGROUND OF THE INVENTION

It is known from the document EP1975747 a watch case according to having a classic monolithic appearance the middle of which consists of a plurality of interchangeable parts. This specific feature of the middle means that each individual part of it may be manufactured in various materials, have different colours, different decorations or different surface treatments. Thus, the buyer of such a watch case may individualise it by selecting each of the seven interchangeable parts from a sample of each of these parts. Once assembled with the parts selected by the customer, the middle, and therefore the watch case, is customised.

The watch case described above has a plurality of drawbacks. First of all, the many parts to be assembled will be mentioned, which results in an increase in manufacturing costs. In addition, the assembly requires a plurality of steps, which results in an increase in manufacturing time. Finally, it will be observed that the decorative parts require specific treatments depending on the aesthetic effect desired by the wearer, which implies a storage of many references.

SUMMARY OF THE INVENTION

In particular, the aim of the invention is to overcome the various drawbacks of these known techniques.

More specifically, one aim of the invention is to provide a watch that is easy and quick to customise.

Another aim of the invention, at least in a particular embodiment, is to provide an exterior element that is simple to implement, easy to assemble and not very expensive.

These aims, as well as others that will subsequently become more apparent, are achieved according to the invention with the aid of a timepiece comprising a watch case formed by a middle closed by a back and a crystal, the middle being equipped with horns defining a space for receiving a bracelet strand, said timepiece comprising a sole arranged to rest against the back, the sole, the bracelet strand and the space between the horns comprising shaped elements arranged to cooperate by interlocking when the middle, the sole and the strand are assembled.

In accordance with other advantageous variants of the invention:

- the shaped elements comprise through holes, said holes being aligned with one another when the middle, the sole and the strand are assembled, and forming a channel arranged to receive a bar holding the middle, the sole and the strand assembled;

- the sole comprises holding studs configured to cooperate with beds of the back and to ensure assembly by clipping;
- the space between the horns comprises a first shaped element having at least one element that protrudes;
- the sole comprises a second shaped element, in accordance with the shape of the space between the horns, the second shaped element comprising at least one cutout arranged to receive the at least one element protruding from the space between the horns;
- the bracelet strand comprises at one of its ends a third shaped element having at least one cutout arranged to cooperate with said at least one element protruding from the space between the horns;
- the sole and the bracelet strand form a single element comprising said second shaped element;
- the sole has an opening to access the back of the watch case;
- the middle and the sole are made of an elastomer material, of a plastic material such as polycarbonate, PMMA or MABS, of metal or a combination of these materials;
- the bracelet strand is made of an elastomer-based material.

Thus, the aim of the present invention, by its various functional and structural aspects described above, makes it possible to obtain a watch that is easy to customise.

SUMMARY DESCRIPTION OF THE DRAWINGS

Other features and advantages of the invention will become more apparent upon reading the following description of a particular embodiment of the invention, given by way of simple illustrative and non-limiting example, and the appended figures, wherein:

FIG. 1 is an exploded view of a watch in accordance with the invention according to a first embodiment;

FIGS. 2*a* and 2*b* are respectively a perspective view of a watch case and a bottom view of a sole in accordance with the invention;

Figure 5A:
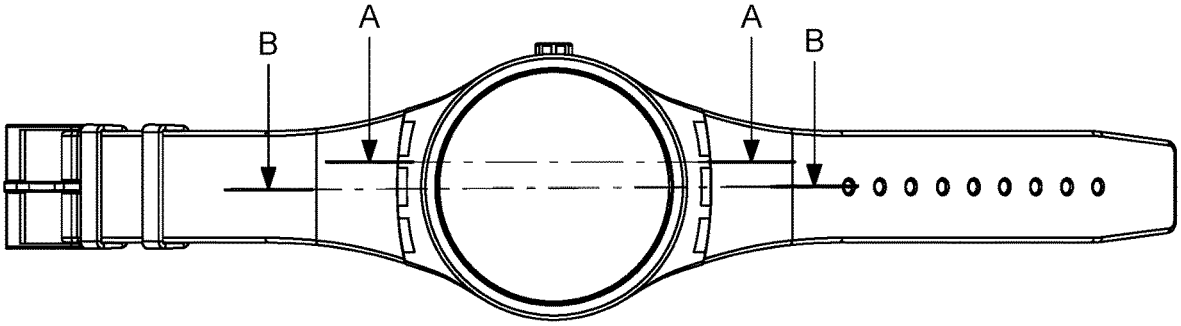
Figure 5B:
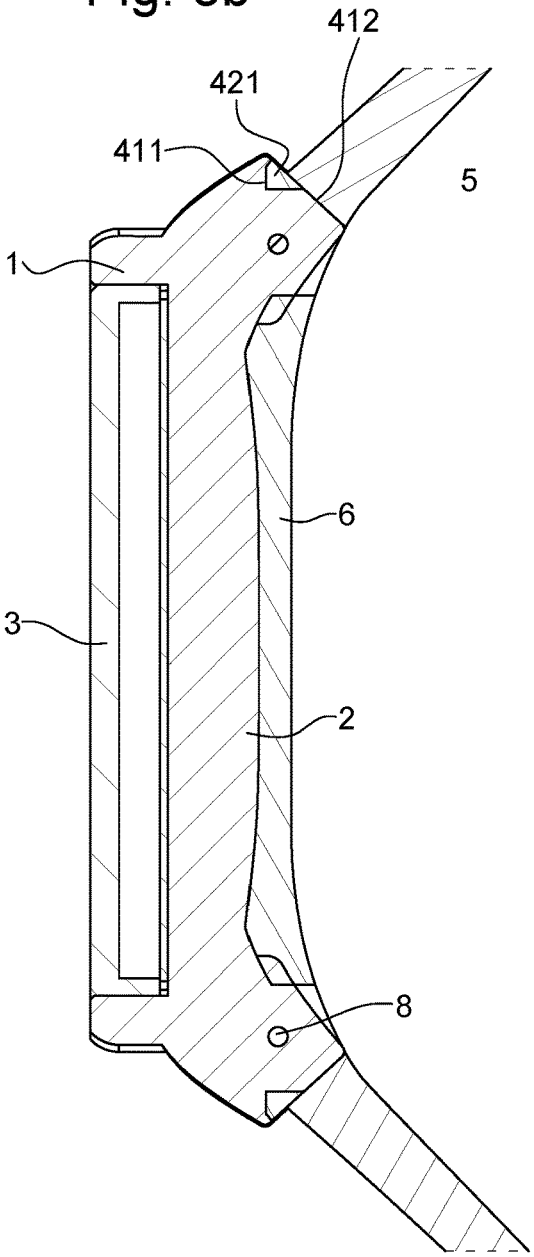
Figure 5C:
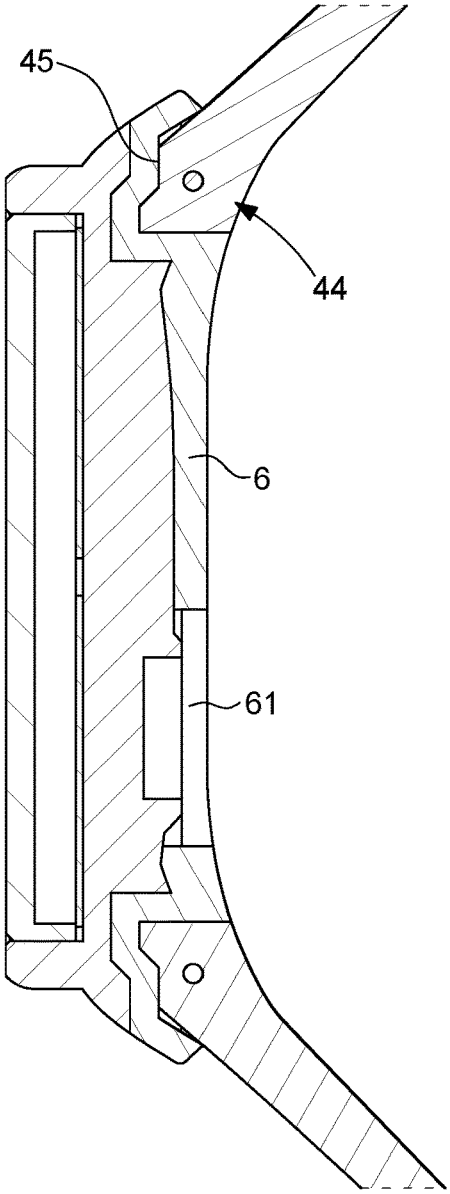
Figure 6:
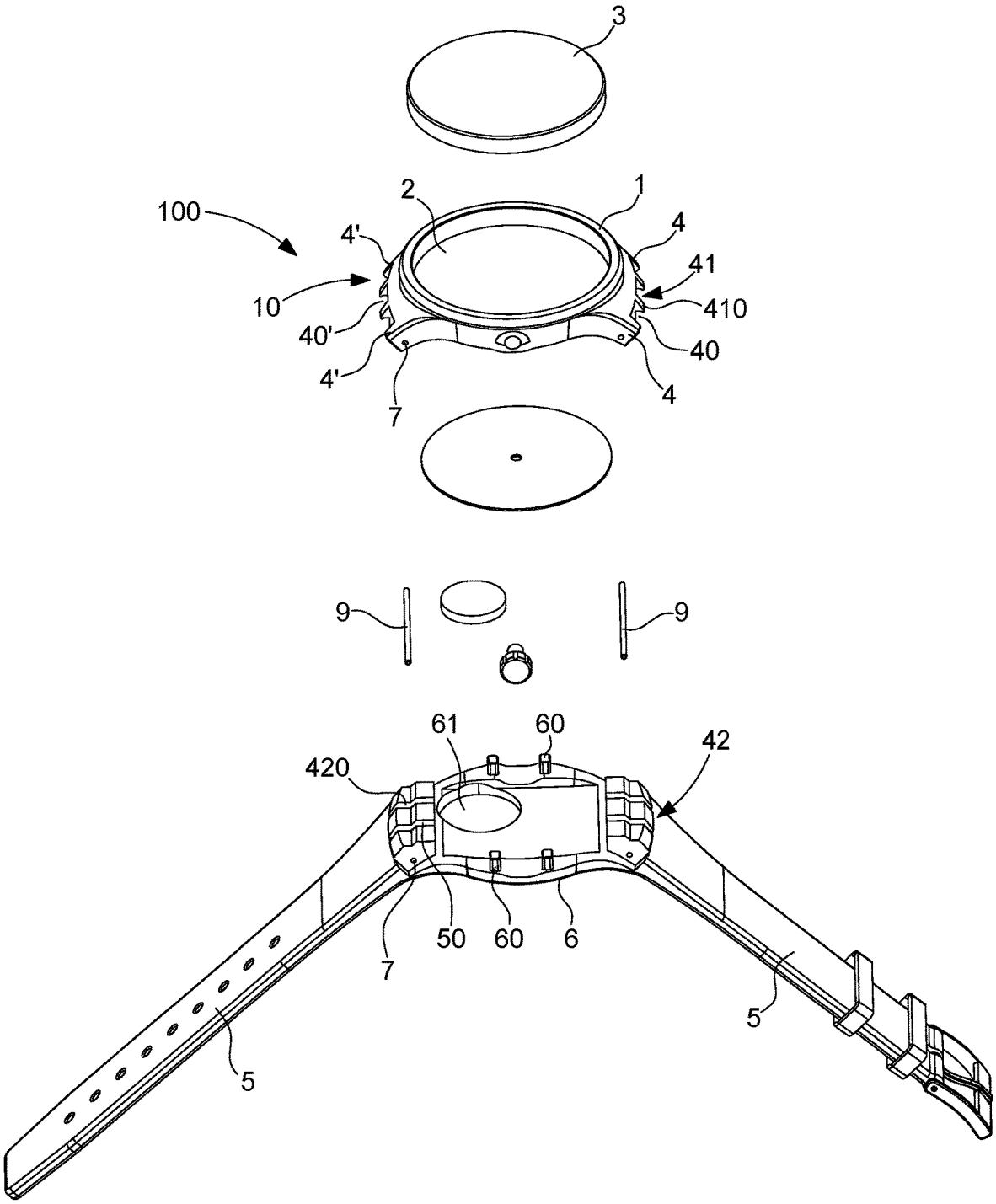

FIGS. 5*a* to 5*c* are respectively a top view, a sectional view along the line A-A and a sectional view along the line B-B of a watch in accordance with the invention;

FIG. 6 is an exploded view of a watch in accordance with the invention according to a second embodiment.

DETAILED DESCRIPTION OF PREFERRED EMBODIMENTS

Figure 1:
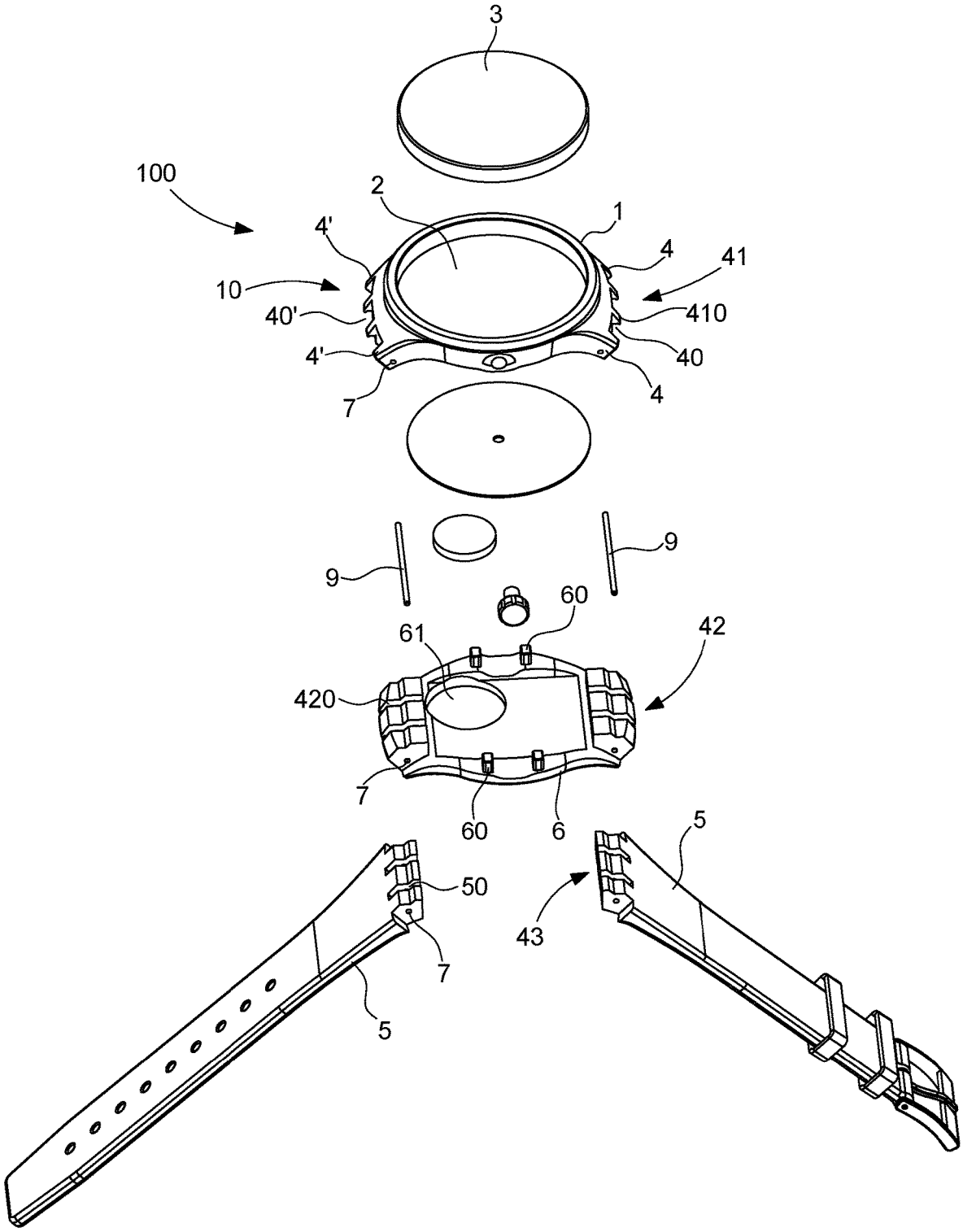

A watch 100 according to one embodiment will now be described in the following making reference jointly to FIGS. 1, 2 and 3.

The general principle of the invention is based on the use of a timepiece 100 comprising a watch case 10 formed by a middle 1 closed by a back 2 and a crystal 3, the middle 1 being equipped with horns 4, 4' defining a space 40, 40', or a connection area, for receiving a bracelet strand 5, said timepiece comprising a sole 6 arranged to rest against the back 2, the sole 6, the bracelet strand 5 and the space between the horns 40, 40' comprising shaped elements arranged to cooperate by interlocking when the middle 1, the sole 6 and the strand 5 are assembled.

The middle 1 comprises, conventionally, at 6 o'clock and 12 o'clock a pair of horns 4 for fastening a strand of a bracelet strand.

Figure 2A:
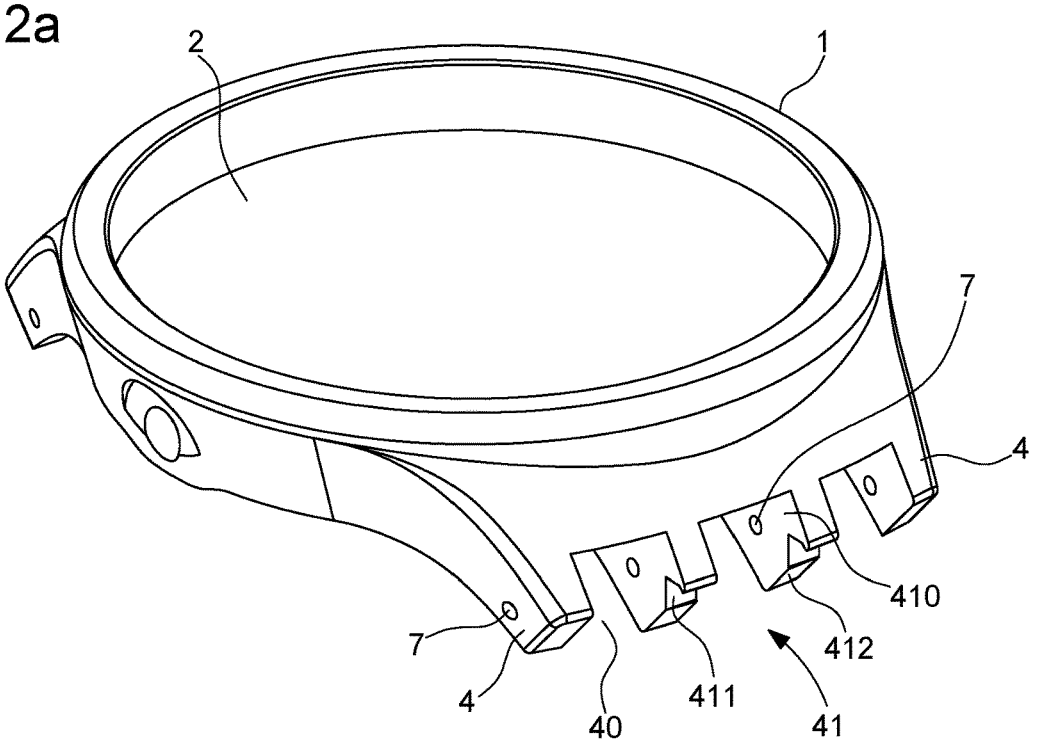
Figure 2B:
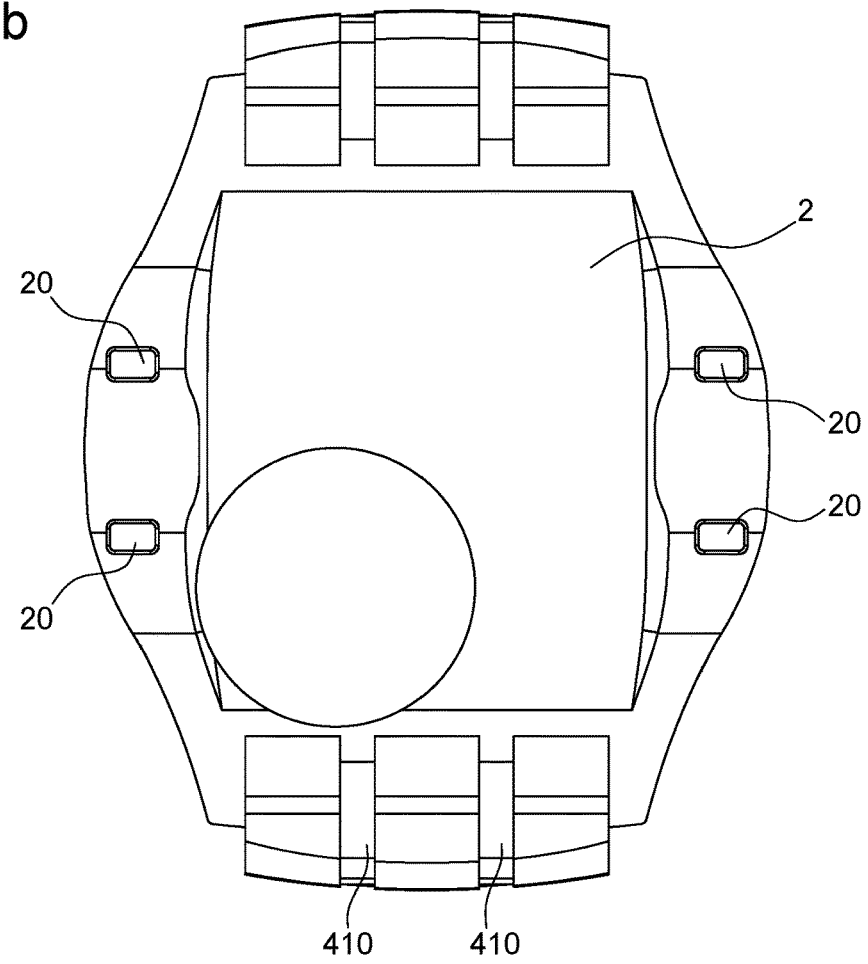

As illustrated in FIG. 2*a*, the space between the horns 40, 40' comprises a first shaped element 41 having at least one element 410 that protrudes from the watch case, and has an oblique contact surface 412 arranged to cooperate with the sole 6. These protruding elements 410 may be comparable to a pair of inner horns for example.

The protruding element 410 is inclined in relation to the horizontal plane of the case so that the bracelet strand adapts correctly to the curvature of the wrist of the wearer when the watch is worn.

Advantageously, the sole 6 comprises a second shaped element 42, in accordance with the shape of the space between the horns 40, 40', the second shaped element 42 comprising at least one cutout 420 arranged to receive the at least one element 410 protruding from the space between the horns when the sole is assembled against the back 2 of the middle 1.

The sole 6 also comprises at least one bed 44 arranged to receive an end of the bracelet strand 5 during the assembly of the various elements, the wall 45 of the bed 44 having a shape complementary to that of the space 40, 40' and of the at least one element 410.

So as to provide secure assembly and prevent any detachment of the sole 6, the latter has holding studs 60 configured to cooperate with cavities 20 formed in the back 2, the studs also being used as markers for the correct positioning of the sole in relation to the middle. According to one variant of the invention, the holding studs 60 each have a hook at their free end and the cavities 20 each have a retention element cooperating with the hooks to ensure assembly by clipping. Once mounted, the sole contours the shapes of the middle 1 and fills the space between the horns 40, 40'. According to the materials selected, the holding studs 60 of the sole 6 may be optional, the stiffness and the frictions being sufficient to provide a good holding.

Optionally, and according to the type of timepiece, the sole has an opening 61 to access the back of the watch case and change a battery for example. Obviously, the size of the opening may vary and have various uses, the person skilled in the art may provide an larger opening making it possible to observe a transparent back for example.

Figure 3:
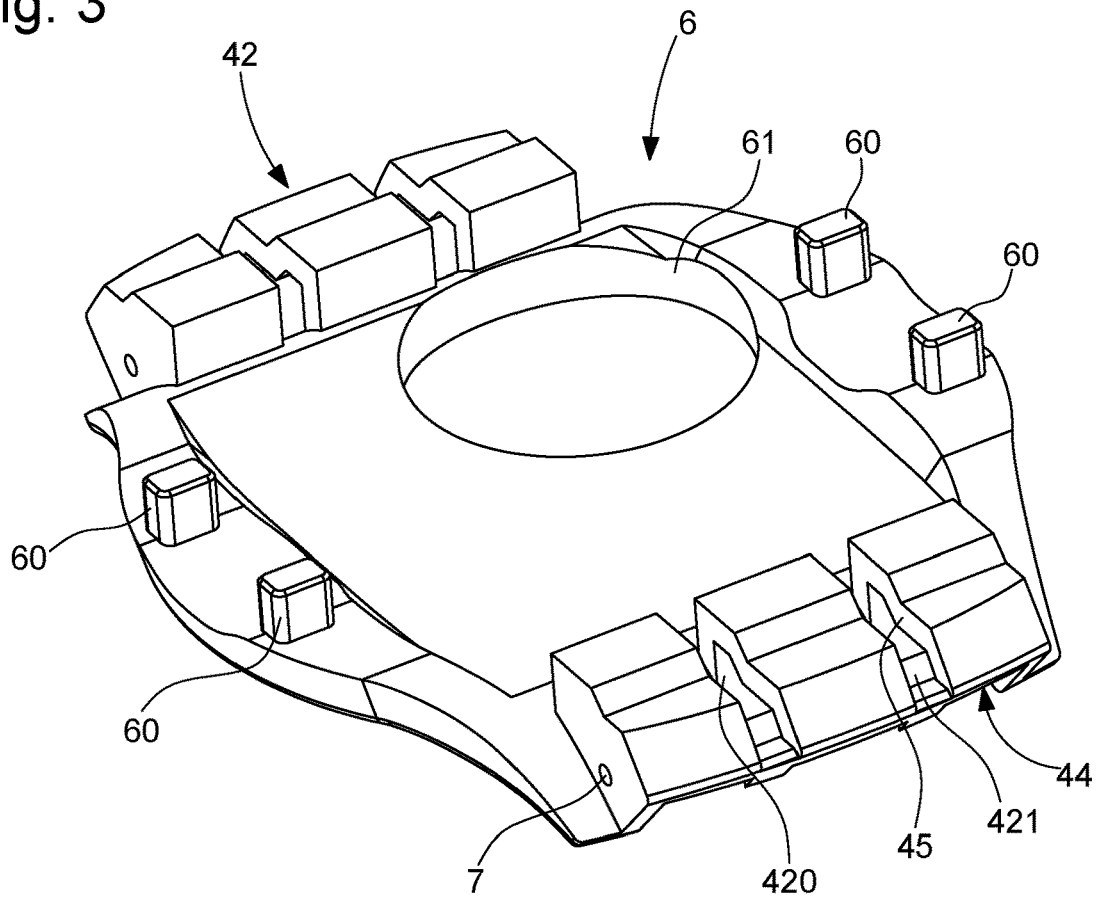
FIG. 3 is a perspective view of a sole of a watch case in accordance with the invention.
Figure 4:
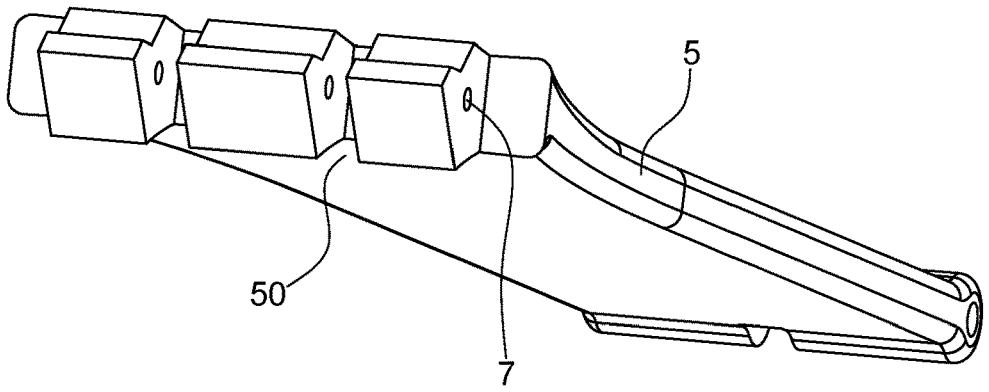
FIG. 4 is a perspective view of a bracelet strand of the watch in accordance with the invention.

It will also be noted in FIG. 3 that the sole 6 has, at the cutouts, a banking 421 arranged to cooperate with the element 410. To this end, the element 410 has a notch 411 cooperating with the banking 421, this assembly enabling both a correct positioning and a good holding of the sole 6 on the back 2 of the middle. Such an arrangement thus makes it possible to hide the space between the horns 40, 40'. It is also possible to eliminate the banking 421 and to assemble the sole 6 on the back 2 of the middle, the interlocking at the horns being sufficient to hold the whole assembled.

According to a first embodiment, the bracelet strand 5 comprises at one of its ends, or the end arranged to be connected to the watch case at the horns, a third shaped element 43 having at least one space 50 arranged to cooperate with said at least one element 410 protruding from the space 40, 40' between the horns, the material around the cutouts resting in the at least one bed 44.

Advantageously, the shaped elements 41, 42 and 43 comprise through holes 7, the holes 7 being aligned with one another when the middle 1, the sole 6 and the strand 5 are assembled with one another, so as to form a channel 8 arranged to receive a bar 9 holding the middle 1, the sole 6 and the strand 5 assembled. The bar 9 acts as a locking element once in place and prevents the assembly from separating.

According to a second embodiment, the sole 6 and the bracelet strand 5 form a single monolithic element, the assembly then comprising the second shaped element and the whole then fastening directly below the middle 1.

The middle and the sole are made of an elastomer material or of plastic material such as polycarbonate, PMMA or MABS, by way of an injection moulding for example. The person skilled in the art would have no difficulty in using other materials such as metals or metal alloys, ceramic materials. According to the final result desired for the watch, the various watch elements may be of matte or shiny aspect, or also transparent or opaque, a combination of these aspects being possible.

The bracelet strand is made of an elastomer-based material, of leather, of metal or ceramic.

Obviously a combination of materials may be used for the various elements, for example a case made of metal material, a sole made of plastic material and a strand made of elastomer material may be used.

It will also be noted that the various elements, namely, the middle, the sole and the bracelet strand, may have various colours depending on the model of the watch.

The middle 1, sole 6 and strand 5 assembly makes it possible to obtain a plurality of customisable models depending on the colour and/or the aspect retained.

The assembly of the watch is performed as follows.

The operator mounts the sole 6 on the middle 1 by interlocking at the space between the horns 40, 40' while making sure that the holding studs 60 are positioned opposite the cavities 20 of the back 2 of the middle 1.

Subsequently, the operator places the bracelet strand so as to interlock the shaped elements 41, 42 and 43 and align the holes 7 of the latter. Finally, the bar 9 is introduced into the channel 8 formed by the holes to secure the whole.

Thanks to these various aspects of the invention, we have a watch that is easy to assemble, enabling a large variety of models and that is easy to customise by the wearer.

Of course, the present invention is not limited to the example illustrated and is susceptible to various variants and modifications that will become apparent to the person skilled in the art.

The invention claimed is:

1. A timepiece comprising:

a watch case formed by a middle closed by a back and a crystal, the middle being equipped with horns defining a space for receiving a bracelet strand; and a sole arranged to rest against the back, wherein the sole, the bracelet strand and the space between the horns define shaped elements arranged to cooperate by interlocking when the middle, the sole and the strand are assembled, and wherein the sole includes holding studs configured to cooperate with cavities formed in the back.

2. The timepiece according to claim 1, wherein the shaped elements comprise through holes, said holes being aligned with one another when the middle, the sole and the strand are assembled, and fo ruing a channel arranged to receive a bar holding the middle, the sole and the strand assembled.

3. The timepiece according to claim 1, wherein the space between the horns comprises a first shaped element having at least one element that protrudes.

4. The timepiece according to claim 3, wherein the sole comprises a second shaped element, in accordance with the shape of the space between the horns, the second shaped element comprising at least one cutout arranged to receive the at least one element protruding from the space between the horns.

5. The timepiece according to claim 3, wherein the bracelet strand comprises at one of its ends a third shaped element having at least one space arranged to cooperate with said at least one element protruding from the space between the horns.

6. The timepiece according to claim 4, wherein the sole and bracelet strand form a single element comprising said second shaped element.

7. The timepiece according to claim 1, wherein the sole has an opening to access the back of the watch case.

8. The timepiece according to claim 1, wherein the middle and the sole are made of plastic material, and wherein the plastic material is polycarbonate, PMMA or MABS.

9. The timepiece according to claim 1, wherein the bracelet strand is made of an elastomer-based material.

10. The timepiece according to claim 1, wherein the holding studs each include a hook at a free end thereof, and the cavities each include a retention element therein to engage with a respective holding stud.

* * * * *